United States Patent [19]

Shaw

[11] 4,180,986

[45] Jan. 1, 1980

[54] REFRIGERATION SYSTEM ON/OFF CYCLE

[75] Inventor: David N. Shaw, Unionville, Conn.

[73] Assignee: Dunham-Bush, Inc., West Hartford, Conn.

[21] Appl. No.: 900,025

[22] Filed: Apr. 25, 1978

[51] Int. Cl.[2] ..... F25B 43/02

[52] U.S. Cl. ..... 62/192; 62/196 B; 62/473; 62/510; 418/84

[58] Field of Search ..... 62/193, 510, 84, 473, 62/196 C, 196 B, 192; 418/84, 87

[56] References Cited

U.S. PATENT DOCUMENTS

| | | | |
|---|---|---|---|
| 3,408,826 | 11/1968 | Soumerai et al. | 62/193 |
| 3,822,564 | 7/1974 | Nijo et al. | 62/196 B |
| 4,063,855 | 12/1977 | Paul | 418/84 |

*Primary Examiner*—William E. Wayner

*Attorney, Agent, or Firm*—Sughrue, Rothwell, Mion, Zinn and Macpeak

[57] ABSTRACT

A positive displacement compressor, such as a helical screw rotary compressor without capacity control element, is coupled in a refrigeration loop main line between the evaporator and an oil separator and upstream of the condensor. To unload the screw compressor at low evaporator load, any refrigerant discharging from the compressor is bypassed by a line connecting the suction and discharge sides of the screw compressor, and main line connection from the evaporator to the screw compressor is shut off such that the driven, unloaded screw compressor pulls oil from the separator through a restrictor and oil injection port and some refrigerant vapor which passes to the evaporator side through the screw compressor bypass line. As the evaporator pressure increases, the evaporator is connected through a restrictor within the main line to the screw compressor suction. As the evaporator load increases, normal operation returns, with the bypass line being closed and oil fed from the oil separator to the screw compressor injection port bypassing the restrictor for that oil line.

6 Claims, 1 Drawing Figure

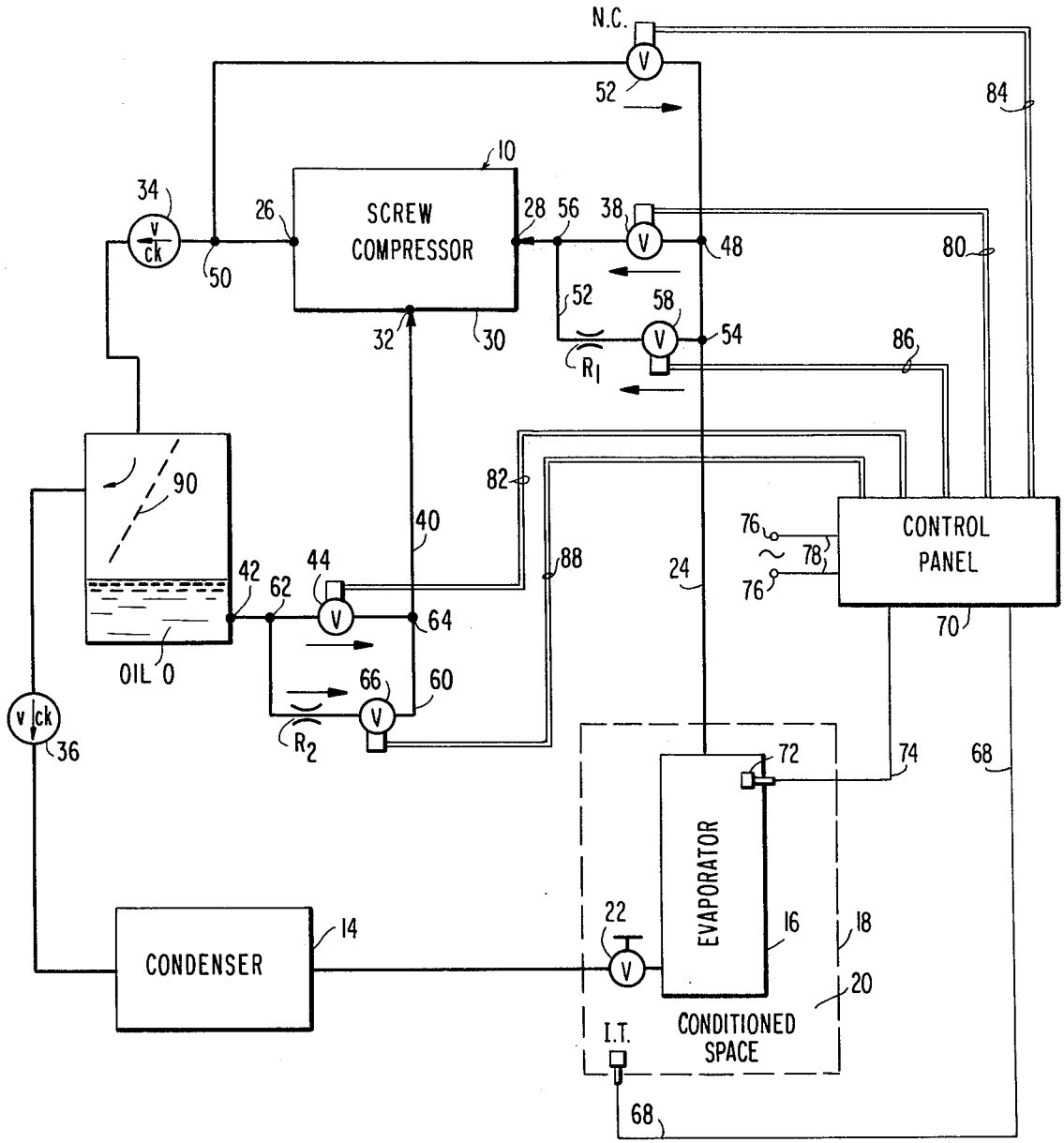
N.C.
V
52
84
10
34
V
ck
26
SCREW
COMPRESSOR
28
56
38
V
48
80
50
52
58
V
54
86
32
30
R1
90
82
40
76
CONTROL
PANEL
78
88
24
42
62
44
V
64
76
70
OIL 0
66
60
V
V
ck
36
R2
72
74
68
EVAPORATOR
22
16
18
CONDENSER
14
V
20
I.T.
CONDITIONED
SPACE
68

REFRIGERATION SYSTEM ON/OFF CYCLE

BACKGROUND OF THE INVENTION

Field of the Invention

This invention relates to refrigeration systems and, more particularly, to systems employing a positive displacement compressor lacking a capacity control element within the compressor itself.

Positive displacement compressors have been employed within refrigeration systems for compressing refrigerant vapor and circulating it through a condensor where the refrigerant vapor is condensed at high pressure and then through an evaporator where the liquid refrigerant expands to remove heat from a space being conditioned by the latent heat of vaporization of the refrigerant, and wherein the vapor is returned to the suction side of the screw compressor feeding the condensor, for recompression. Where the positive displacement compressor constitutes a rotary compressor, such as a rotary sliding vane compressor or a helical screw rotary compressor, it is conventional to supply oil along with the refrigerant vapor to improve the volumetric efficiency of the compression process, seal the intermeshed helical screw, lubricate the mechanical moving elements of the compressor, and cool the compressor and the refrigerant working fluid.

In oil-flooded helical screw compressors of this type, it is conventional to separate the oil from the refrigerant downstream of the compressor and upstream of the condensor, and to recirculate the oil, particularly by the employment of an oil injection feed line which connects the oil separator to a injection port within the helical screw compressor casing which opens to the intermeshed helical screws intermediate of the suction and discharge sides of the screw compressor such that the oil is injected under pressure into a closed thread containing a mass of refrigerant vapor acting as the working fluid as it is compressed by passage through the screw compressor.

Conventionally, helical screw rotary compressors include a capacity control slide which functions to permit a portion of the refrigerant vapor entering the suction side of the compressor to be returned to that suction side or inlet, decreasing the mass of compressed refrigerant being compressed and, thus, reducing the capacity of the screw compressor. While such slide valves have permitted very efficient reduction in capacity to about 50% load, most of the machine is unloaded beyond that degree, and capacity control produced by the slide valve in that range is inefficient when pressure ratios are high.

It is therefore a primary object of the present invention to provide an improved refrigeration system employing a positive displacement compressor, such as a helical screw rotary compressor, in which the compressor is permitted to operate essentially unloaded under low system load conditions with low energy input.

It is a further object of the present invention to provide an improved refrigeration system of this type which is particularly applicable to a positive displacement compressor of the oil-flooded type, wherein the moving components of the compressor remain lubricated when the compessor is operated essentially under zero load conditions.

SUMMARY OF THE INVENTION

The present invention is directed to a refrigeration system comprising an evaporator, a condensor, an oil-flooded positive displacement compressor having suction and discharge sides, a first, main line carrying refrigerant and oil and connecting said evaporator, said compressor and said condensor in a closed-series loop, in that order, an oil separator within said loop and positioned between said screw compressor and said condensor, a second, oil injection supply line extending from said oil separator to said compressor for injecting separated oil into the compressor at a pressure intermediate of the refrigerant line pressure between the suction and discharge sides of said compressor, and means, responsive to low refrigerant load conditions of the evaporator coil, for disconnecting the outlet of the evaporator coil from the suction side of the compressor, for connecting the outlet side of the evaporator to the discharge side of the screw compressor and for causing the oil within the oil injection supply line to pass through a restrictor within that line effecting gradual rise in refrigerant pressure within the evaporator while feeding a limited supply of oil to the compressor to maintain compressor lubrication. Preferably, in response to a predetermined rise in evaporator pressure, means are further provided for connecting the evaporator to the suction side of the compressor through a restrictor to pull the evaporator pressure back down to a predetermined evaporator pressure corresponding to the low refrigerant load subjected to that evaporator to prevent excessive condensation from occurring in the evaporator during part load operation.

Further means are provided for insuring unrestricted flow of refrigerant from the evaporator to the suction side of the compressor during normal load conditions and unrestricted flow of oil from the oil separator to the oil injection port of the compressor during normal load conditions and for eliminating the bypass connection around the screw compressor between the discharge side of the screw compressor and the evaporator coil outlet.

Preferably, a first main line carrying refrigerant and oil connects the evaporator, said compressor and said condensor in a series refrigeration loop, in that order, with the oil separator positioned within the main line and between the screw compressor and the condensor. A second line connects the oil separator to the compressor for injecting separated oil from the refrigerant vapor into the compressor at a pressure intermediate of the compressor suction and discharge pressures. A third line connects said evaporator to the discharge side of the compressor to bypass the compressor. Said first line includes a first control valve upstream of the suction side of the said compressor. A fourth line coupled to said first line bypasses said first control valve and inludes a restrictor therein, and has a second control valve therein. A fourth control valve is carried within said second line, a fifth line coupled to said second line bypasses said fourth control valve, said fifth line including a restrictor therein and having a fifth control valve within that line. A pressure sensing means is provided within said evaporator, and a thermostat is provided within said conditioned space. Means responsive to the pressure sensed by said pressure sensing means and the temperature sensed by said thermostat control system operation such that under normal refrigerant load conditions, said first, second, fourth and fifth control valves are open and said third control valve is closed such that suction return refrigerant from said evaporator passes directly to the suction side of said screw compressor for compression by said screw compressor and passage to said oil separator and said condensor prior to returning to the evaporator through said first line, separated oil passes unrestricted through said second line from the oil separator to the screw compressor. When said condition space reaches a given predetermined reduced temperature, said first and second control valves are caused to immediately close, and said fourth control valve to close shortly thereafter, wherein the suction side of the compressor is pulled down into the vacuum range, and the discharge side of the compressor is bled off to the low pressure existing in the system evaporator, with the compressor operating under essentially no-load at low electrical power consumption, oil is fed to the compressor through the restrictor within line five bypassing the fourth valve and evaporator pressure gradually rises, and subsequently, said second control valve is alternately opened and closed to maintain the evaporator pressure at a predetermined low pressure representative of low evaporator load conditions to prevent excessive condensation in the evaporator during part-load operation.

BRIEF DESCRIPTION OF THE DRAWING

FIG. 1 is a schematic diagram of the improved refrigeration system on/off cycle constituting one embodiment of the present invention.

DESCRIPTION OF THE PREFERRED EMBODIMENT

Reference to the drawing illustrates one embodiment of the present invention as applied to a refrigeration system which includes a helical screw rotary compressor of conventional construction and illustrated generally at 10. The other principal components of the on/off cycle refrigeration system of the present invention comprises oil separator 12, condensor 14 and evaporator 16. Evaporator 16 is positioned within an enclosure 18 for conditioning a space 20 and is provided with a thermal expansion valve 22.

The components are connected in a closed-loop refrigeration circuit comprising a main or first conduit means or line 24, with the screw compressor 10 positioned intermediate of the evaporator 16 and the condensor 14, and with the oil separator 12 connected to the discharge side 26 of the screw compressor opposite the suction or inlet side 28 of that compressor. The helical screw rotary compressor may comprise a hermetic compressor unit or the like, including a casing 30, which casing carries a oil injection port 32 for the injection of oil into the screw compressor helical screw rotors (not shown) for cooling, lubricating and sealing purposes. The main or first line 24 includes a first check valve 34 downstream of the discharge side 26 of the compressor and upstream of the oil separator 12. Line 24 further comprises a second check valve 36 between the oil separator and the condensor 14, each of these valves permitting refrigerant flow, respectively, from the screw compressor to the oil separator and from the oil separator to the condensor, but not refrigerant flow in the opposite direction. Positioned within the first or main refrigerant line 24, upstream of the screw compressor suction side 28, is a first control valve 38 which may comprise a solenoid operated control valve which is normally open, but which, when energized, closes, and thus disconnects the evaporator 16 from the suction side of the screw compressor.

The system further comprises a second oil injection supply line 40 which connects to the oil separator at point 42, line 40 terminating at screw compressor oil injection port 32. Line 40 includes a solenoid operated control valve 44. This solenoid operated control valve 44 is also normally open, but when energized, closes line 40 from the oil separator to the screw compressor injection port 32. The system further comprises a third line 46 which connects to the first line at point 48 and to the same line 24 on the opposite side of the screw compressor adjacent the discharge port or side 26, at point 50, line 46 bypassing the screw compressor and connecting the compressor discharge side to the evaporator 16. The third line 46 carries a solenoid operated control valve 52 which is normally closed, but which is opened upon energization. A fourth line 52 connects to the first line 24 at point 54 and to the same line at point 56 upstream of the inlet side or inlet port 28 of the screw compressor, thus bypassing the solenoid operated control valve 38. Line 52 includes a first restrictor $R_1$ and in series therewith, a solenoid operated control valve 58. The circuit further comprises a fifth line 60 connect to the second line 40 at point 62 to one side of the solenoid operated control valve 44 and to the same line at point 64 on the opposite side of that control valve so as to bypass the control valve 44. The fifth line 60 includes a second restrictor $R_2$ which restricts the flow of oil through this line 60 which bypasses the control valve 44 and which includes, in series with the restrictor $R_2$, a solenoid operated control valve 66. Further, within enclosure 18 being conditioned, and specifically within space 20, the system comprises a indoor thermostat IT which provides a signal indicative of the temperature within that space, and supplies that temperature signal via line 68 to a control panel 70. Further, a pressure sensor or sensing device 72 within the evaporator coil and sensitive to the pressure of the refrigerant within the evaporator is connected via line 74 to the control panel 70. A source of electrical voltage (not shown) is connected via terminals 76 through lines 78 to the control panel for supplying the current for energization of the solenoid operated control valves 38, 44, 52, 58 and 66. In this regard, control lines 80 lead from control panel 70 to solenoid operated control valve 38, control lines 82 connect solenoid operated control valve 44 to the control panel 70, lines 84 connect solenoid operated control valve 52 to that panel, control lines 86 connect solenoid operated control valve 58 to the panel and control lines 88 connect solenoid operated control valve 66 to that panel. As may be appreciated, oil separator 12 functions to separate the oil by way of a baffle 90, for instance, such that the oil accumulates in the bottom of the separator and refrigerant retained above that oil passes on to the condensor 14 as vapor through check valve 36. The screw compressor 10 or equivalent positive displacement compressor is preferably operated continuously whether loaded or not. Further, while we have identified the compressor 10 as being a helical screw rotary compressor and have indicated that it is without capacity control elements, and while such capacity control means conventionally consist of a capacity control slide valve, it may well be that the helical screw rotary compressor carry slide valves, such as a gas injection slide valve, a gas ejection slide valve, and an over-expansion, under-expansion/over-compression, under-compression slide valve, all of which would be operated in conjunction with control parameters for the system not germane to the on/off cycle control system of the illustrated invention. Those slide valves could be controlled in conjunction with parameters, such as condition space temperature and evaporator pressure, which is essentially the saturated suction pressure of the suction port or suction side 28 of the screw compressor. Further, the enclosure 18 may comprise a chiller tank bearing a chiller liquid such as water.

In the operation of the illustrated system, under normal full capacity mode of operation with the condition space 20 requiring heat removal, the indoor thermostat IT is calling for full load evaporation by the evaporator 16 and feeding an electrical signal indicative of the same through line 68 to the control panel 70. The control panel acts to de-energize solenoid operated control valves 38, 44, 52, 58 and 66 (valves 38, 44, 58 and 56 being normally open when de-energized) such that a refrigerant vapor returning from the evaporator passes through the main or first line 24 and by way of restrictor $R_1$ and control valve 38 to the suction side or suction port 28 of the helical screw compressor 10 for compression. Since solenoid operated valve 52 is de-energized and line 46 is closed, the refrigerant vapor discharging at high pressure from the screw compressor at the discharge port 26 passes through the check valve 34 to the oil separator 12 where the refrigerant vapor R passes onto the condenser 14 for condensation through further check valve 36. The oil O separated within the oil separator passes in an unrestricted manner through the second line 40 to the oil injection port 32 for injection into the screw compressor.

Now, if the temperature in the conditioned space 20 drops below the set point of the indoor thermostat IT, the following sequence of events will occur. At appropriate signal is sent from indoor thermostat IT through line 68 to the control panel 70 which causes solenoid operated control valve 52 to be energized, opening the line 46 bypassing the screw compressor 10, while simultaneously signals are sent through lines 80 and 86, energizing the solenoid operated control valves 38 and 58 to close the main line connections 24 to the screw compressor while permitting the discharge port 26 of the screw compressor to be connected through bypass line 46 to the evaporator 16. Further, by appropriate time delay means (not shown) within the control panel 70, solenoid operated control valve 44 is energized through lines 82 while the solenoid operated control valve 66 remains de-energized and oil is forced to flow through the bypass line 60, by passing the solenoid operated control valve 44 with the oil passing through the restrictor $R_2$ prior to entering the screw compressor at the oil injection port 32. By the closure of solenoid operated control valves 38 and 58, the suction or low side of the compressor 10 at suction port 28 is pulled down into the vacuum, the high side at discharge port 26 of the screw compressor is bled off to the low pressure existing in the system evaporator 16 through bypass line 46 which connects to the main line 24 at point 48. The screw compressor 10 is now operating without any load whatsoever and most of the rotors are in a vacuum zone, thus, extremely low power consumption is taking place with respect to the screw compressor.

During this unload/load operation, the evaporator pressure will gradually rise since the system still feeds some oil through the restrictor $R_2$ to the screw compressor and line 40 in order to maintain compressor lubrication under zero load conditions. Further, since the solenoid operated control valve 52 is energized and line 46 is open, this solenoid operated control valve will allow the small feed of oil and refrigerant vapor that is being generated out of the oil within oil line 40 to bleed back to the low side of the evaporator. The thermal expansion valve 22 would preferably be controlled, by program within control panel 70 in such a manner that liquid refrigerant would be prevented from reaching the evaporator coil 16 from condensor 14. Thus, the evaporator pressure gradually rises until the pressure sensor 72 senses that rise to a predetermined pressure value with a signal indicative of the same passing through line 74 to the control panel 70, causing the de-energization of solenoid operated control valve 58 and permitting the suction port or suction side 28 of the screw compressor to be connected through restrictor $R_1$ to the evaporator 16. The solenoid operated control valve 58 will be allowed to remain open until the evaporator pressure within evaporator 16 is pulled back down to a predetermined point, at which it is to be maintained under zero load conditions, thus preventing excessive condensation from occuring in the evaporator during this part or zero load operation, the solenoid operated control valve 58 periodically opening and closing to maintain these conditions under the control of pressure sensor 72. Obviously, under these circumstances, there is no net cooling on the evaporator 16, and the conditioned space 20 will gradually rise in temperature. Once the conditioned space temperature rises to the set point of the indoor thermostat IT, an appropriate signal is generated through line 68 to the control panel 70, causing solenoid operated control valve 52 to become de-energized closing line 46 and causing solenoid operated control valves 38, 44, 58 and 66 to be de-energized, returning the system to normal operation under full compressor load.

It is obvious from the above that there is provided for the on/off cycle refrigeration system an operating technique wherein the off-loading efficiency is very high. In order to improve the efficiency of the system, it may be possible to incorporate a two-speed motor for the positive displacement compressor so that displacement may be reduced at the same time that the system is off-loaded. The system is extremely useful for all types of refrigeration systems, large food freezer warehouses, and for temperature control and for conventional chiller system where the evaporator 16 constitutes a water chiller coil. Further, while the compressor 10 has been identified as a helical screw rotary compressor, preferably of the hermetic type, the present invention has application to a control system wherein the compressor is any positive displacement compressor, such as centrifugal, rotary sliding vane, reciprocating piston, etc.

While the invention has been particularly shown and described with reference to a preferred embodiment thereof, it will be understood by those skilled in the art that various changes in form and details may be made therein without departing from the spirit and scope of the invention.

What is claimed is:

1. An on/off cycle refrigeration system comprising: (a) an evaporator; (b) a condensor; (c) an oil-flooded positive displacement compressor having low suction and high discharge sides; (d) a first line carrying refrigerant and oil and connecting said evaporator, said compressor and said condenser in a closed-series loop, in that order; (e) an oil separator within said loop and positioned between said compressor and said condensor; (f) a second line connected between the oil separator and the compressor for supplying separated oil to the compressor for lubrication, the improvement comprising:

(a) means responsive to low load conditions of said evaporator for connecting the low side of the evaporator to the discharge side of the compressor and for cutting off the low side of the evaporator to the suction side of said compressor; and (b) means for restricting the flow of oil from said oil separator through said second line to said compressor such that the low side of the screw compressor is pulled down into the vacuum range, and the high side of the screw compressor is bled off to the low pressure existing in the system evaporator, with the compressor operating at essentially zero load under low power consumption and with limited lubricating oil being fed to the compressor.

2. The on/off cycle refrigeration system as claimed in claim 1 further comprising means responsive to increase in evaporator pressure responsive to refrigerant pressure within the evaporator for permitting refrigerant flow from the low side of the evaporator to the suction side of the compressor through a restrictor cyclically to permit the evaporator pressure to be maintained at a predetermined minimal value.

3. The on/off cycle refrigeration system as claimed in claim 2 wherein said first line comprises a first solenoid operated control valve upstream of the suction side of said screw compressor, a fourth line is connected across a portion of said first line and bypasses said first solenoid operated control valve, said fourth line including a restrictor for restricting the flow of refrigerant flow therethrough and a second solenoid operated control valve, a third line includes a third solenoid operated control valve connecting the suction and discharge sides of said compressor and comprises said means for connecting the low side of evaporator to the discharge side of the compressor, said second line including a fourth solenoid operated control valve between said oil separator and said screw compressor, a fifth line is connected across said second line and bypasses said fourth solenoid operated control valve, said fifth line including a restrictor therein and a fifth solenoid operated control valve, a thermostat is positioned within the space conditioned by said evaporator and responsive to load conditions on the evaporator, and a pressure sensor is positioned within said evaporator for sensing the pressure of the refrigerant vapor therein, a control panel is operatively connected to said thermostat, said pressure sensor, said solenoid operated control valves and to a source of electrical current to energize said solenoid operated control valves such that, under normal full load conditions, the refrigerant is prevented from flowing through said third line but flows through said first, second, fourth and fifth lines, and, under essentially zero load conditions as determined by the load on the evaporator, said control valves cause initially at low pressure within said evaporator coil, oil flow through said fifth line around said fourth valve and through said restrictor with the low side of the evaporator coil being open to the high side of the screw compressor through said third line, and with refrigerant flow shut off from the low side of the evaporator coil to the suction port of the screw compressor, and, under increased pressure conditions within said evaporator, restricted refrigerant flow from the low side of the evaporator to the suction port of the screw compressor through the restrictor within said fourth line, bypassing said first solenoid operated control valve.

4. The on/off cycle refrigeration system as claimed in claim 1 wherein said compressor comprises a helical screw compressor including an oil injection port between the suction and discharge sides of said compressor, and said second line connects the oil separator to said oil injection port.

5. The on/off cycle refrigeration system as claimed in claim 2 wherein said compressor comprises a helical screw compressor including an oil injection port between the suction and discharge sides of said compressor, and said second line connects the oil separator to said oil injection port.

6. The on/off cycle refrigeration system as claimed in claim 3 wherein said compressor comprises a helical screw compressor including an oil injection port between the suction and discharge sides of said compressor, and said second line connects the oil separator to said oil injection port.

* * * * *